United States Patent [19]

Born et al.

[11] Patent Number: 4,737,298

[45] Date of Patent: Apr. 12, 1988

[54] PROCESS FOR MANUFACTURING SOLUBLE ORGANIC CALCIUM COMPLEXES, THE RESULTANT COMPLEXES AND THEIR USE, PARTICULARLY AS ADDITIVES FOR IMPROVING THE COMBUSTION OF GAS OILS AND FUEL OILS

[75] Inventors: Maurice Born, Nanterre; Lucienne Briquet; Guy Parc, both of Rueil-Malmaison; Nicole Thevenin, Paris, all of France

[73] Assignee: Institut Francais du Petrole, Rueil-Malmaison, France

[21] Appl. No.: 25,040

[22] Filed: Mar. 12, 1987

Related U.S. Application Data

[63] Continuation of Ser. No. 463,703, Feb. 4, 1983, abandoned.

[30] Foreign Application Priority Data

Feb. 5, 1982 [FR] France ..... 82 02026

[51] Int. Cl.[4] ..... C01M 135/10

[52] U.S. Cl. ..... 252/18; 252/33.2; 252/33.4

[58] Field of Search ..... 252/18, 33.2, 33.4, 252/51.5 A

[56] References Cited

U.S. PATENT DOCUMENTS

| | | | |
|---|---|---|---|
| 3,282,835 | 11/1966 | Asseff | 252/18 X |
| 3,372,115 | 3/1968 | McMillen | 252/18 X |
| 3,377,283 | 4/1968 | McMillen | 252/18 X |
| 3,451,931 | 6/1969 | Kahn et al. | 252/18 X |
| 3,515,669 | 6/1970 | Lesuer | 252/18 X |
| 3,539,511 | 11/1970 | Sabol et al. | 252/33.4 X |
| 3,714,042 | 1/1973 | Greenough | 252/33.4 X |
| 3,853,774 | 12/1974 | Crocker | 252/18 X |
| 4,059,536 | 11/1977 | Lallement et al. | 252/33.3 |
| 4,218,328 | 8/1980 | Vaughan | 252/33.2 X |

*Primary Examiner*—Jacqueline V. Howard
*Attorney, Agent, or Firm*—Millen & White

[57] ABSTRACT

Soluble organic calcium complexes are prepared by (a) reacting a sulfonic acid with an excess of calcium oxide or hydroxide over the stoichiometry in a liquid medium comprising a hydrocarbon or a halohydrocarbon, methanol and a $C_3$ or $C_4$ alcohol, in the presence of a nitrogen compound having a long hydrocarbon chain, (b) reacting the resultant product with carbon dioxide and (c) recovering the resultant calcium complex.

14 Claims, No Drawings

PROCESS FOR MANUFACTURING SOLUBLE ORGANIC CALCIUM COMPLEXES, THE RESULTANT COMPLEXES AND THEIR USE, PARTICULARLY AS ADDITIVES FOR IMPROVING THE COMBUSTION OF GAS OILS AND FUEL OILS

This application is a continuation of application Ser. No. 463,703 filed Feb. 4, 1983, now abandoned.

BACKGROUND OF THE INVENTION

This invention relates to an improved process for manufacturing soluble organic calcium complexes, usable particularly as additives improving the combustion of liquid fuels. It also relates to the complexes obtained by this process and their uses.

The combustion of liquid hydrocarbons such as, for example, gas oil, heating oil, light fuels, heavy fuels or kerosine oil, leads, even under the best possible economic conditions, to a more or less substantial amount of solid, liquid or gaseous unburned substances, such as, for example, soot, cracked hydrocarbons, carbon monoxide as well as nitrogen oxides. These unburned materials have as main disadvantages to decrease the yield of the power plants (fuel oil burners, Diesel engines, etc), due to a loss of combustible material and to the formation of deposits (particularly soot) on the heat exchangers, which results in a decrease of the heat transfer coefficients, and to produce injurious fumes which must be reduced as much as possible. In an attempt to obviate these disadvantages, soluble organic iron, calcium or barium compounds are generally added to the liquid fuels (for example gas oil or fuel oil), in order to inhibit the production of fumes or at least to reduce the amount thereof. These compounds operate by catalytic effect to improve the combustion of the fuels and reduce the weight of the solid combustion residues.

SUMMARY OF THE INVENTION

It has now been found that soluble organic calcium complexes can be prepared, which have an increased calcium content as compared with the content of soluble organic calcium complexes obtained by the processes of the prior art.

It has been found that sulfonic calcium complexes can be prepared by a process using only reduced molar proportions of organic binder (hydrocarbyl sulfonic acid). This process is advantageous, particularly when using, as reactant, an alkyl benzene sulfonic acid of relatively high molecular weight, for example of about 400 to 500, since the sulfonic acids of this type cannot provide very high calcium contents when using a manufacturing method of the prior art.

More generally the soluble organic complexes of the invention are obtained by a process comprising:

(a) reacting an aliphatic, alicyclic or aromatic sulfonic acid with an excess of calcium oxide or hydroxide (with respect to the proportion corresponding to the formation of basic calcium sulfonate) in a liquid medium generally comprising a dilution mineral oil, a hydrocarbon or halohydrocarbon solvent, as well as methanol and a $C_3$ or $C_4$ monoalcohol, in the presence of a compound having nitrogen groups and a long hydrocarbon chain;

(b) contacting the resultant reaction mixture of step (a) with a sufficient amount of carbon dioxide to carbonate a substantial proportion of the calcium oxide or hydroxide in excess, and (c) separating the resultant calcium complex, obtained in the organic phase.

DETAILED DISCUSSION

The so-defined process results in the production of sulfonic complexes having a very high calcium content, as a result of simultaneous use of methanol and of a second alcohol in particular proportions as shown hereinafter. A particularly important advantage lies in the operation being performed within a single liquid phase, the reaction water being maintained in solution by the presence of the second alcohol; conversely, in the absence of this alcohol, the apparition of an aqueous alcoholic phase disturbs substantially the carbonation operation.

In the first step of the process according to the invention, there is first used a sulfonic acid which may be aliphatic, alicyclic or aromatic, in most cases an aromatic sulfonic acid.

Examples of aromatic sulfonic acids are the alkylbenzene sulfonic acids comprising about 10 to 20 carbon atoms. Other examples are the alkylbenzene sulfonic acids of industrial grade (referred to as "heavy alkylbenzene sulfonic acids") which comprise about 20 to 35 carbon atoms.

As indicated above, a minor proportion of at least one compound having nitrogen groups and at least one long hydrocarbon chain is also used, this compound having the effect of improving the solubilization of the sulfonic complex in the hydrocarbon medium.

The compound with nitrogen groups and long hydrocarbon chain(s) may consist, for example, of a polyalkenylsuccinimide-amine or a bis(polyalkenylsuccinimide)-amine of the general formulas:

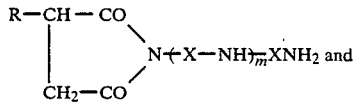

and

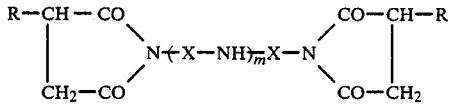

wherein R is a substantially saturated aliphatic hydrocarbon radical comprising 20 to 250 carbon atoms, preferably 75 to 100, X is an alkylene radical of 2–5 carbon atoms whose two valences are located on distinct carbon atoms, and m has a value of 1 to 5, preferably 1 to 3.

Among these compounds, there can be more particularly mentioned those whose R radical results from the polymerization or the copolymerization of one or more light olefins having, for example, from 2 to 6 carbon atoms, for example, ethylene, propylene, 1- and 2-butenes, isobutene or 2-methyl-1-pentene. More particularly, the radical R may be a polyisobutenyl radical, having a molecular weight of about 900–1300. The radical X is often a $—CH_2—CH_2—$ ethylene radical and m has, for example, the value of 3.

In this particular case, the manufacture of the polyalkenylsuccinimide amine or the bis(polyalkenylsuccinimide)-amine employs polyisobutenylsuccinic anhydride and tetraethylenepentamine in a proportion of 1

(or 2) mole(s) of anhydride per mole of tetraethylenepentamine.

The operating procedure for manufacturing (bis)-polyalkenylsuccinimide-amines is well known in the art: it is disclosed, for example, in the French Pat. No. 1 265 085 and No. 1 422 401.

Other compounds with nitrogen groups and a long hydrocarbon chain to be mentioned are the amino-acids of the general formula:

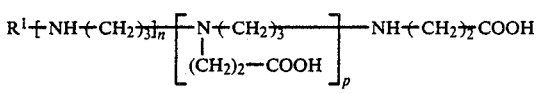

wherein $R^1$ is a monovalent hydrocarbon radical (for example an aliphatic radical) comprising 6 to 22 carbon atoms, n is an integer from 0 to 4 and p is zero when n is zero, or 0, 1 or 2 when n is different from zero.

Particular examples of these compounds comply with the following formulae:

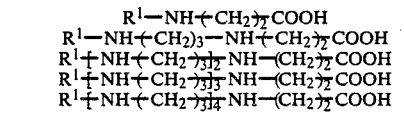

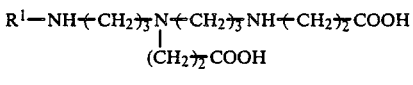

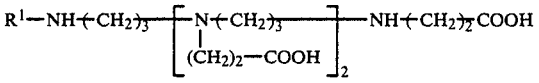

where $R^1$ is defined as above and may be, for example, a mixture of alkyl radicals with 12 to 14 carbon atoms.

The compound with nitrogen groups and a long hydrocarbon chain is generally introduced into the reaction mixture in a proportion of 10 to 30% by weight and preferably 15 to 25% by weight of the sulfonic acid reacted.

The reaction medium usually comprises a dilution oil which generally consists of a mineral oil of low viscosity for example a 100 Neutral Solvent oil. The proportion by weight of this oil with respect to the sulfonic acid generally corresponds to a ratio of from about 1:5 to 2:1.

The process of the invention makes use of a hydrocarbon or halohydrocarbon solvent consisting more particularly of an aromatic hydrocarbon such as, for example, benzene, toluene, xylene, mono- or di-ethylbenzene or mono- or di-isopropylbenzene; or a halogenated aliphatic hydrocarbon such as, for example, trichloroethylene. Various oil cuts may also be used, such as gas oil or domestic fuel oil.

When the soluble organic calcium complex of the invention is to be used as a solution, it is advantageous to use a solvent of sufficiently high boiling point to prevent its removal in the operating conditions of the final step of additive production such as defined hereinafter. Solvents of this type are, for example, diisopropylbenzene, gas oils or domestic fuel oils.

The so-defined hydrocarbon or halohydrocarbon solvent is generally used in a proportion of 1 to 10 kg per kilogram of sulfonic acid.

The $C_3$ or $C_4$ mono-alcohol is preferably isopropanol.

Methanol and the $C_3$ or $C_4$ mono-alcohol are generally introduced in a total proportion of from 80 to 1000 ml per liter of hydrocarbon or halohydrocarbon solvent. The volumic ratio of the $C_3$ or $C_4$ alcohol to methanol is at most 3.5:1. It may be as low as, for example, 1:100 but the preferred values are in the range of from 1.5:1 to 3:1.

When operating according to the process of the invention, calcium oxide is introduced in the reaction mixture in excess with respect to the stoichiometry concerning the basic calcium sulfonate (corresponding to 1 gram-atom of calcium per gram-equivalent of sulfonic acid). Thus, depending on the proportion of calcium to be introduced into the complex, and taking the yield of the subsequent carbonation operation into account, the proportion of calcium oxide or hydroxide to be used may range from 1 to 30 gram-atoms of calcium per gram-equivalent of the sulfonic acid.

There is generally used calcium hydroxide (or slaked lime).

The first step of the process conforming with the invention may be effected by heating the reaction mixture as described above to a temperature of 20° to 65° C. (preferably of about 55° to 60° C.), under efficient stirring, so as to neutralize the sulfonic acid.

In the second step of the process for manufacturing sulfonic complexes according to the invention, a substantial proportion, preferably the largest possible proportion, of the excess of oxide or hydroxide dispersed within the reaction mixture is subjected to carbonation. Carbonation is generally performed with gaseous carbonic anhydride, in the pure state or diluted with a gas which is inert with respect to the reactants, in an extremely divided state, the reaction mixture being maintained, always under stirring, at a temperature of 20° to 65° C. and preferably between 55° and 60° C.

The resultant liquid contains unreacted oxide or hydroxide in suspension since the carbonation yield cannot be 100%. The carbonation yield decreases with an increased excess of oxide or hydroxide.

The importance of this excess must be so determined as to introduce the best proportion of metal into the complex, without having to remove a too large proportion of unreacted oxide or hydroxide.

The volatile constituents of the resultant mixture (water, methanol, second alcohol, toluene, benzene, chlorinated solvent, etc.) are eliminated, for example, by evaporation under reduced pressure in a thin layer rotative evaporator. The solid particles of unreacted metal oxide or hydroxide are removed, for example, by filtration or centrifugation.

When the hydrocarbon solvent is volatile, the additive obtained in the above conditions appears as a vitreous solid completely soluble in the oil hydrocarbons.

When the solvent to be used is a heavy hydrocarbon, for example diisopropylbenzene or gas oil, the soluble organic complexes of the invention are collected as a very fluid limpid liquid also containing the dilution oil optionally introduced at the beginning.

The use of a determined proportion of heavy hydrocarbon solvent results in solutions of the soluble organic complex which have conveniently, for easier processing, a metal content of about 10% by weight. The obtained amount of complex solution represents generally a very high proportion of the theoretically obtainable amount (about 85 to 95%).

The soluble organic calcium complexes obtained by the process of the invention may have very high calcium contents. Thus, the proportion of calcium may range from 5 to 20 gram-atoms of calcium per gram-equivalent of the sulfonic acid.

These soluble organic calcium complexes may be used as additives for improving the combustion of various liquid fuels (gas oil, fuel oil). They are then added to these fuels in a proportion which may range, for example, from 10 to 150 ppm, more preferably 25 to 75 ppm, by weight of calcium with respect to the liquid fuel.

The substantial improvement in the manufacture of soluble organic calcium complexes resulting from the use of the process of the invention also applies to the manufacture of calcium sulfonates of high basicity reserve used as detergent-dispersant additives in lubricating oils.

The simultaneous use of methanol and a $C_3$ or $C_4$ alcohol in the above-mentioned relative proportions represents a substantial improvement in the processes described in French Pat. No. 2,236,001 and in French Pat. No. 2,265,848 and in its addition certificate No. 2,271,281, corresponding to U.S. Pat. No. 4,059,536. The content of these patents and addition certificate is included herein by way of the reference made thereto.

The following examples illustrate the invention but the scope of the latter must not be limited to the particular practical embodiments described therein. The examples 3, 4, 6 to 10 and 13 are given for comparison.

In all these examples, the total base number of the products (called T B N) has been determined in accordance with the standard ASTM D 664-58.

EXAMPLE 1

There is used a 2 liter glass reactor provided with a double jacket, an efficient stirrer, a tube with a porous end to introduce finely divided gas, a thermometer and a co-axial glass/calomel electrode. There is successively introduced thereinto:

312.5 g of a synthesis heavy alkylbenzene sulfonic acid (having an equivalent molecular weight of about 700 g, taking unsulfonated content of 30% b.w. into account), thus 0.45 mole of acid;

70 g of a bis(polyalkenylsuccinimide)-amine of the general formula

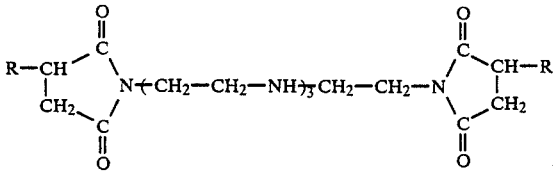

wherein R is a polyisobutenyl radical having a molecular weight of 1200 to 1300; the polyamine group being obtained from tetraethylene pentamine. The product of the trade, having a TBN of 20, consists of a 50% by weight solution of this amine in a lube oil base of low viscosity.

114.5 g of a 100 Neutral Solvent mineral oil 1000 ml of diisopropylbenzene 180 ml of absolute isopropyl alcohol 60 ml of absolute methyl alcohol 446 g of pure carbonate-free slaked lime.

The temperature of the mixture is raised to 50° C. by means of the fluid heat carrier of the jacket while the mixture is efficiently stirred.

111.3 liter of $CO_2$ (4.64 mole or 204 g) are then added in 4 hours by means of the gas distribution pipe placed in the suspension, while maintaining the reaction temperature between 55° and 60° C., under stirring.

The pH of the mixture is controlled in relation with the % of $CO_2$ introduced. The resultant brown solution, containing the lime excess, is transferred into a thin layer layer evaporator where it is freed of its volatile constituents (water, alcohols) by evaporation under reduced pressure (110° C., 30 mmHg). The resultant hot suspension is transferred into a mono-plate filter of the GAUTHIER type (filtration surface: 113 $cm^2$) and then filtered in about one hour under an effective pressure of 2 bars. There is thus collected 1100 g of a very fluid limpid organic solution constituting the additive, amounting to about 60% b.w. of the theoretical proportion.

The filtration cake is dispersed with twice 500 cc of hexane, and the resultant suspension is filtered again under 2 bars.

The filtrates are collected and then evaporated under 30 mmHg at 120° C.; there is finally obtained 1737 g of an additive titrating 10% b.w. of calcium, representing 95% b.w. of the theoretical amount of additive to be obtained.

The additive has the following physico-chemical characteristics:

| | |
|---|---|
| Ca | 10% b.w. |
| TBN | 260 |
| Viscosity at 40° C. (cSt) | 17 |
| Viscosity at 100° C. (cSt) | 5 |
| Specific gravity (20° C.) | 1.07 |
| Flash point pensky (° C.) | 68 |
| Appearance | translucent brown liquid |

EXAMPLE 2

The experiment of example 1 is repeated, while replacing diisopropylbenzene with the same volume of a light oil solvent: toluene.

After carbonation, the suspension is transferred into the GAUTHIER filter where it is filtered in about one hour under an effective pressure of 2 bars. After wash of the filtration cake with twice 500 cc or hexane, the filtered hydrocarbon fractions are freed of their volatile constituents in the thin layer rotative evaporator (reaction water, alcohols, toluene). There are thus obtained 915 g of an additive appearing at room temperature as a very viscous translucent liquid, completely soluble in the oil hydrocarbons and which represents about 93.5% b.w. of the theoretical amount of additive to be obtained.

The recovered additive has the following properties:

| | |
|---|---|
| Ca | 20.2% b.w. |
| TBN | 540.2 |
| Specific gravity at 20° C. | 1.30 |

The high TBN figure indicates a colloidal calcium carbonate content of about 48.1% of the total amount of additive, and a calcium sulfonate content of about 24.6%, which shows that the ratio of the number of calcium atoms to the number of molecules of acid contained therein is about 10.7, or again that the ratio of the number of calcium atoms, in the colloidal carbonate state, to the number of calcium atoms as sulfonate is about 21.3.

EXAMPLE 3

(Comparison)

The experiment is conducted as in example 1 except that methyl alcohol is replaced with the same volume of pure isopropyl alcohol, i.e. the total volume of this alcohol is 240 cc (total absence of methyl alcohol).

It is found that the carbonation of calcium oxide terminates when only 10% of the expected amount of $CO_2$ have been introduced into the reaction mixture. The resultant suspension of milky aspect is practically unfilterable under 2 bars.

EXAMPLE 4

(Comparison)

Example 1 is repeated except that isopropyl alcohol is replaced with the same volume of methyl alcohol, i.e the total volume of the latter alcohol is 240 cc (no isopropyl alcohol present).

After carbonation and evaporation of the volatile constituents, there is only obtained after more than 5 h of filtration under 2 bars, 1422 g of additive solution titrating 10.8% b.w. of calcium.

EXAMPLE 5

The experiment of example 1 is repeated, except that diisopropylbenzene is replaced with the same volume of Diesel oil. There is obtained 1744 g of a solution containing 9.75% b.w. of calcium, i.e. about 95.4% b.w. of the theoretical amount of additive to be obtained.

EXAMPLES 6 TO 11

A number of experiments are effected in the conditions of example 1, while using mixtures of methyl alcohol and isopropyl alcohol in various proportions.

The results of Examples 1 to 11 are reported in Table 1.

It can be observed, in Example 3, that isopropanol when used in the same proportion as the mixture of alcohols of example 1, is not adapted to the carbonation of calcium oxide.

It is found, in Example 4, that the replacement of isopropanol with methanol allows the carbonation of calcium oxide; however, the reaction is not as satisfactory as in Example 1, when using a mixture of both alcohols, as shown by the excessive filtration time and the low yield obtained.

When repeating examples 1 and 4 with the mixtures left unstirred after the carbonation, two liquid phases appear after centrifugation when operating with the suspension obtained in Example 4, while only one liquid phase appears in Example 1. The chromatographic analysis of the recovered uncolored upper phase shows that the latter consists essentially of methanol and water.

It thus appears that the better carbonation conditions of Example 1 result from the maintenance in solution of the reaction water, due to the presence of isopropyl alcohol acting as compatibilizing agent.

Example 3, however, shows the necessity to have methanol present in the medium since isopropanol is unsuitable, when used alone, to perform the operation.

EXAMPLE 12

The experiment of example 2 is repeated while using the following amounts of reactants:

TABLE I

| Example No. | ALCOHOL (ml) METHYL | ALCOHOL (ml) ISOPROPYL | pH DETERMINATION $CO_2$ supplied (% of the expected 4.64 moles of $CO_2$) 0 | 10 | 25 | 50 | 75 | 90 | 95 | 100 | FILTRATION TIME UNDER 2 BARS (*) (h) | YIELD of ADDITIVE (%) | % Ca b.w. in the ADDITIVE |
|---|---|---|---|---|---|---|---|---|---|---|---|---|---|
| 1 | 60 | 180 | 10.6 | 9.1 | 9.7 | 10.2 | 10.3 | 10.4 | 10.5 | 10.5 | 1 | 95 | 10 |
| 2 | 60 | 180 | 10.6 | 9 | 9.6 | 10.2 | 10.2 | 10.4 | 10.5 | 10.4 | 1 | 93.5 | 20.2 |
| 3 | 0 | 240 | 10.1 | <7.8 | | End of the carbonation | | | | | — | — | — |
| 4 | 240 | 0 | 10.3 | 9.4 | 9.5 | 9.7 | 9.1 | 7.8 | <7 | — | >5 | 84 | 10.8 |
| 5 | 60 | 180 | 10.2 | 9.4 | 9.7 | 9.9 | 10.1 | 10.3 | 10.3 | 10.2 | 1.25 | 95.4 | 9.75 |
| 6 | 100 | 0 | 10.3 | 9.3 | 9.4 | 9.5 | 9 | 7.2 | <7 | — | >5 | 91 | 10.3 |
| 7 | 30 | 0 | 10.2 | — | | End of the carbonation | | | | | — | — | — |
| 8 | 40 | 0 | 10.2 | 9.3 | 9.4 | 8.5 | 7 | <7 | — | — | — | — | — |
| 9 | 60 | 250 | 10.1 | 7.2 | | End of the carbonation | | | | | — | — | — |
| 10 | 60 | 210 | 10.2 | 5.6 | | End of the carbonation | | | | | — | — | — |
| 11 | 60 | 120 | 9.7 | 9.3 | 9.6 | 9.8 | 10 | 10 | 9.9 | 9.7 | 2 | 87 | 9.8 |

(*)Filtration surface: 113 $cm^3$
Volume of oil solvent (Diisopropylbenzene or Toluene): 1000 $cm^3$.

| | |
|---|---|
| sulfonic acid | 189.3 g (0.27 mole) |
| bis-succinimide-amine | 42 g |
| 100 Neutral solvent oil | 68.7 g |
| $Ca(OH)_2$ | 595 g |
| Toluene | 1000 cc |
| isopropyl alcohol | 180 cc |
| methyl alcohol | 60 cc |

The carbonation is effected by introducing 210 g of $CO_2$ (4.77 mole) in 4 hours under the above described temperature conditions. There is finally obtained 520 g of additive representing about 65% b.w. of the theoretical amount. The additive appears in these conditions as a liquid which is extremely viscous at room temperature but can be handled easily at 100° C.; it is entirely soluble in oil hydrocarbons.

Its physico-chemical characteristics are the following:

| | |
|---|---|
| Ca | 23.8% b.w. |
| TBN | 648.6 |
| Specific gravity | 1.367 |

The high measured value of the TBN is indicative of a colloidal calcium carbonate content of about 58% of the total weight of the additive.

The determination of the amount of sulfonic acid in the additive (after separation of the constituents by dialysis and regeneration of the sulfonic acid with hydrochloric acid addition; thus about 17.7% b.w. of the additive amount) shows that a portion only of his acid is present in the additive and that the ratio of the number of calcium atoms to the number of molecules of the acid present is about 17.4, or again that the ratio of the number of calcium atoms in the colloidal carbonate state to the number of calcium atoms in the sulfonate state is about 34.4, which is a quite remarkable result.

The use of a methanol-isopropanol mixture also provides a substantial improvement to certain processes for manufacturing superbasic detergent additives for lubricants known in the prior art, as shown by the following experiments.

EXAMPLE 13

(Comparison example)

In a continuously stirred 6 $m^3$ reactor, there are successively introduced:

| | |
|---|---|
| pure methyl alcohol | 0.75 $m^3$ |
| lime | 403 kg |
| sulfonic acid of example 1 | 592 kg |
| Mineral oil | 201 kg |
| Toluene | 2.25 $m^3$ |
| Neutral sulfurized calcium dodecylphenate | 207 kg |

The temperature of the mixture is raised to 40° C., then 177 kg of $CO_2$ are added in 3 hours.

The mixture is then left unstirred for 1.5 hour; two liquid phase separate:

an upper liquid phase: it consists essentially of reaction water, methyl alcohol and toluene, and also of traces of calcium-containing solid organic substances which accumulate at the bottom of the distillation column when recovering the solvents, which is an important disadvantage.

a lower liquid phase: it consists essentially of toluene wherein the prepared superbasic detergent additive is dissolved.

This solution is filtered, then supplied to a fractionation column to remove residual methyl alcohol and traces of reaction water. This fraction of high alcohol content is then admixed with the upper phase and fed to the distillation column to recover the alcohol.

The detergent additive thus obtained after toluene removal has a calcium content of 12.9% b.w. and a TBN of 340.

EXAMPLE 14

The experiment of example 13 is repeated, except that the 0.75 $m^3$ of methyl alcohol are replaced with 0.75 $m^3$ of mixture of:

| | |
|---|---|
| pure isopropyl alcohol | 0.563 $m^3$ |
| pure methyl alcohol | 0.187 $m^3$ |

After reaction, the mixture is left unstirred for 1.5 hour; no liquid phases separation occurs.

The single liquid phase, containing the additive, is filtered and then supplied as above to a distillation column to recover the solvents.

The solvent-free additive is recovered in the liquid state at the bottom of the column; no accumulation of solid organic products is observed.

The superbasic detergent additive obtained in these improved operating conditions has the following properties which are very close to those of the additive obtained in the preceding example:

| | |
|---|---|
| Ca | 12.8% b.w. |
| TBN | 330 |

EXAMPLE 15

An additive prepared according to the process of example 1 is used in a series of experiments relating to the decrease of the "BOSCH" fume number in an INDENOR PEUGEOT engine.

The additive is added to the Diesel oil at concentrations of from 0.5 to 2 parts per thousand parts of oil.

The fume number is determined in each experiment according to the "BOSCH" method.

The results obtained with the additive-free gas oil and then with the additive-containing gas oil are given in the following Table. Results obtained with a barium-containing additive of the trade are also given for comparison.

TABLE II

| ADDITIVE OF EXAMPLE No. 1 l/$m^3$ of gas oil | Ca in gas oil ppm | FUME NUMBER 1st Exper. | 2nd Exper. | 3rd Exper. | AVERAGE |
|---|---|---|---|---|---|
| Gas oil alone | 0 | 3.5 | 3.5 | 3.5 | 3.5 |
| 0.5 | 50 | 2.6 | 2.5 | 2.5 | 2.55 |
| 1 | 100 | 1.9 | 1.9 | 1.9 | 1.9 |
| 2 | 200 | 1.4 | 1.4 | 1.4 | 1.4 |
| Barium additive of the trade | Ba = 100 ppm | 2.3 | 2.3 | 2.3 | 2.3 |

EXAMPLE 16

An additive prepared according to the method of example 1 is used in a series of experiments relating to the decrease of the unburned particles emission rate of a heavy fuel No. 2.

The additive is used in the heavy fuel No. 2 (viscosity at 100° C.: 36.3 cSt) at 2 concentrations corresponding to 50 and 100 ppm b.w. of calcium.

The same experiment is performed with the additive-free heavy fuel (blank experiment), as in the preceding example.

In the experiment, the heavy fuel is mechanically atomized under a pressure of 29 bars; the fuel feed rate is 90 kg/h. The air admission temperature is 25° C. and the air excess amounts to 25%.

The blackening number by weight is determined in each experiment according to the standard NF X 43-003. It corresponds to the proportion by weight of solid particles for 1 therm; it is expressed as mg/th. One therm corresponds to $10^6$ calories, or 4.18 $10^6$ J.

The results are given in the following Table, as well as the efficiency of the additive corresponding to a relative decrease of the blackening number (as compared with the value of the blank experiment).

TABLE III

| ADDITIVE OF EXAMPLE No. 1 l/m³ fuel oil | Ca in the fuel ppm | BLACKENING NUMBER BY WEIGHT OF THE FUEL mg/th | EFFICIENCY OF THE ADDITIVE |
|---|---|---|---|
| 0 | 0 | 612 | 0 |
| 0.5 | 50 | 526 | 14 |
| 1 | 100 | 275 | 55 |

What is claimed is:

1. In a process for manufacturing a hydrocarbon-soluble superbasic organic calcium complex, comprising the steps of:

(a) reacting at least one aliphatic, alicyclic or aromatic sulfonic acid with an excess of calcium oxide or calcium hydroxide over that required to neutralize the sulfonic acid, said reaction being effected in a liquid medium consisting essentially of (A) at least one liquid hydrocarbon, halohydrocarbon, gas oil or domestic fuel oil solvent, and (B) and alcohol promoter, and in the presence of at least one solubility-improving compound having amine groups and at least one long hydrocarbon chain;

(b) contacting the resultant mixture with a sufficient amount of carbon dioxide to carbonate a substantial proportion of the carbonatable calcium oxide or calcium hydroxide; and (c) removing the volatile reaction constituents and separating solid particles of unreacted calcium oxide or hydroxide, and recovering resultant hydrocarbon-soluble superbasic organic calcium complex, the improvement wherein said alcohol promoter is a mixture of isopropanol and methanol, in an isopropanol/methanol volumetric ratio of from 1.5:1 to 3:1, the amount of said promoter alcohol mixture being sufficient to maintain said reaction substantially in a single liquid phase , said resultant superbasic organic calcium complex being easily filterable, produced in a high yield, and having a high calcium content and a high basicity reserve.

2. In a process for manufacturing a hydrocarbon-soluble superbasic organic calcium complex, comprising the steps of:

(a) reacting at least one aliphatic, alicyclic or aromatic sulfonic acid with an excess of calcium oxide or calcium hydroxide over that required to neutralize the sulfonic acid, said reaction being effected in a liquid medium consisting essentially of (A) at least one hydrocarbon, halohydrocarbon, gas oil or domestic fuel oil solent, and (B) an alcohol promoter, and in the presence of at least one solubility-improving compound having amine groups and at least one long hydrocarbon chain;

(b) contacting the resultant mixture with a sufficient amount of carbon dioxide to carbonate a substantial proportion of the carbonatable calcium oxide or calcium hydroxide; and (c) removing the volatile reaction constituents and separating solid particles of unreacted calcium oxide or hydroxide, and recovering resultant hydrocarbon-soluble superbasic organic calcium complex, the improvement wherein said alcohol promoter is a mixture of isopropanol and methanol, in an isopropanol/methanol volumetric ratio of from 0.01:1 to 3.5:1, said volumetric ratio resulting in better filterability as compared to the use of either isopropyl alcohol or methanol alone, the amount of said promoter alcohol mixture being sufficient to maintain said reaction substantially in a single liquid phase, and the resultant superbasic organic calcium complex having a high calcium content and a high basicity reserve.

3. A process according to claim 1 wherein the volumetric proportion of isopropanol to methanol is 3:1.

4. A process according to claim 1, wherein said liquid medium further comprises a mineral oil of low viscosity in a proportion by weight of 1:5 to 2:1 with respect to the sulfonic acid.

5. A process according to claim 1, wherein the solvent (A) is selected from the aromatic hydrocarbons, the halogenated aliphatic hydrocarbon, the gas oils and the domestic fuel oils.

6. A process according to claim 1, wherein said solvent (A) is used in a proportion by weight of 1:1 to 10:1 with respect to the sulfonic acid.

7. A process according to claim 1, wherein said alcohol promoter mixture of isopropanol and methanol is used in a total volumetric proportion of 8:100 to 1:1 with respect to said solvent (A).

8. A process according to claim 1, wherein said solubility-improving compound comprising amine groups and a long hydrocarbon chain is selected from the polyalkenylsuccinimide-amines of the general formula

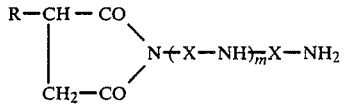

and the bis(polyalkenylsuccinimide)-amines of the general formula

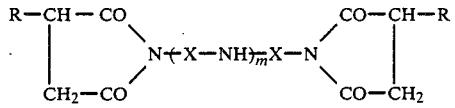

where R represents a substantially saturated aliphatic hydrocarbon radical comprising 20 to 25 carbon atoms, X represents an alkylene radical of 2 to 5 carbon atoms whose two valences are located on distinct carbon atoms and m has a value of 1 to 5.

9. A process according to claim 1, wherein said solubility-improving compound comprising amine groups and a long hydrocarbon chain is selected from the amino-acids of the general formula:

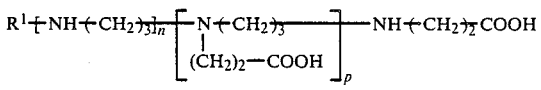

where $R^1$ represents an aliphatic hydrocarbon radical comprising 6 to 22 carbon atoms, n is an integer from 0 to 4 and p is zero when n is zero, or 0, 1 or p is 2 when n is different from zero.

10. A process according to claim 1, wherein said solubility-improving compound having amine groups and a long hydrocarbon chain is used in a proportion of 10 to 30% by weight of the sulfonic acid reactant.

11. A process according to claim 1, wherein, in the step a, calcium oxide or hydroxide is used in a proportion of from 1 to 30 gram-atoms of metal per gram-equivalent of the sulfonic acid.

12. A process according to claim 1, wherein step a is effected at a temperature of 20° to 65° C.

13. A process according to claim 1, wherein, in step b, the reaction mixture resulting from step a is contacted with carbon dioxide in finely divided state.

14. A process according to claim 1, wherein step (b) is effected at a temperature of 20° to 65° C.

* * * * *

UNITED STATES PATENT AND TRADEMARK OFFICE

CERTIFICATE OF CORRECTION

PATENT NO. : 4,737,298

DATED : April 12, 1988

INVENTOR(S) : Maurice Born et al

It is certified that error appears in the above-identified patent and that said Letters Patent is hereby corrected as shown below:

Column 13, Claim 9, Line 1:

Reads: "to 4 and p is zero when n is zero, or 0, 1 or p is 2 when"

Should Read: --to 4 and p is zero when n is zero, or p is 0, 1 or 2 when--

Signed and Sealed this

Twenty-seventh Day of September, 1988

*Attest:*

DONALD J. QUIGG

*Attesting Officer*

*Commissioner of Patents and Trademarks*